US005964596A

United States Patent [19]

Vicich et al.

[11] Patent Number: 5,964,596

[45] Date of Patent: Oct. 12, 1999

[54] REMOVABLE BODY FOR AN ELECTRICAL CONNECTOR

[75] Inventors: Brian R. Vicich; John K. Hynes, both of Louisville, Ky.; David L. Decker, New Albany, Ind.

[73] Assignee: Samtec, Inc., New Albany, Ind.

[21] Appl. No.: 09/017,464

[22] Filed: Feb. 2, 1998

[51] Int. Cl.[6] ..... H01R 4/24

[52] U.S. Cl. ..... 439/78; 29/764; 29/423; 439/943

[58] Field of Search ..... 439/78, 885, 943; 29/739, 423, 741, 764

[56] References Cited

U.S. PATENT DOCUMENTS

| | | | |
|---|---|---|---|
| 4,045,868 | 9/1977 | Ammon et al. | 439/943 |
| 4,061,405 | 12/1977 | Minter | 439/83 |
| 4,894,911 | 1/1990 | Jones | 29/739 |
| 5,169,347 | 12/1992 | Sang | 439/885 |
| 5,208,968 | 5/1993 | Camsell et al. | 29/739 |
| 5,373,626 | 12/1994 | Youngfleish | 29/739 |

*Primary Examiner*—Gary F. Paumen
*Assistant Examiner*—Briggitte R. Hammond
*Attorney, Agent, or Firm*—Woodard, Emhardt, Naughton, Moriarty & McNett

[57] ABSTRACT

A removable body for an electrical connector assembly. An electrical connector assembly includes a removable body and a plurality of substantially uniformly spaced pins or leads engaged thereto. The removable body includes a pair of oppositely opposed lever arms, biased in a first position, each lever arm including at least one abutment member and a gripping element. The removable body may also include a plurality of struts disposed between the lever arms and rotatably engaged at each end to a respective one of the lever arms. The removable body also includes a tee section diposed between the lever arms. The tee section includes a flange portion supported by the abutment members, and a web portion disposed between the abutment members. The flanges define a plurality of substantially uniformly spaced holes for receiving the pins. The pins are frictionally engaged to the web portion by the abutment members when the lever arms are in the first position. When the lever arms are actuated, the lever arms rotate about respective ends of the struts to release the abutment members from the pins, thus allowing the pins to easily move relative to the removable body.

18 Claims, 3 Drawing Sheets

REMOVABLE BODY FOR AN ELECTRICAL CONNECTOR

TECHNICAL FIELD OF THE INVENTION

The present invention generally relates to electrical connectors, and, more particularly, to a removable body for an electrical connector.

BACKGROUND OF THE INVENTION

Electrical connectors are commonly used in the electronics industry in order to facilitate the electrical interconnection of various components. Such connectors are typically formed with a connector body including a row of a specified number of positions, with each position containing one or more connection sites. For example, a twelve position dual in-line connector will have twelve positions of two pins or connection sites each, for a total of twenty-four pins. Similarly, a twelve position single in-line connector will have twelve positions for a single pin or connection site, for a total of twelve pins.

Electrical connectors may generally be divided into two classes: through-hole connectors and surface mount connectors. Surface mount connectors include a connector body having a conductive lead for each position protruding from the bottom surface of the connector body. Each lead is formed in a curved configuration such that the lead rests on a conductive pad on the surface of a printed circuit board. The surface mount leads are soldered to the conductive pads.

Through-hole connectors, on the other hand, include a connector body having a row of conductive pins which protrude from the bottom surface of the body and extend through holes formed in the printed circuit board to which the connector is mounted. Each of these pins is soldered to a conductive trace on the opposite side of the printed circuit board from the connector. For example, if a through-hole connector has twelve pins, twelve through-holes will be formed in the printed circuit board with the same dimensional spacing between the through-holes as between the connector pins. In addition, a through-hole connector may have a pin protruding from the top of the connector body to allow a second printed circuit board to be mounted and electrically connected to the first board as described above.

Both surface mount connectors and through-hole connectors generally include a connector body, which is designed to maintain the desired spacing and length of the conductive leads in the case of a surface mount connector, or the pins in the case of a through-hole connector. The connector body is formed with the appropriate sized and spaced receptacles for holding the required number of leads or pins. Typically, the connector body is composed of a reinforced, plastic type material. The connector body is designed so that it grippingly engages the pins or leads, and may be used to easily and quickly place the leads or pins of the connector in the desired position or through the desired through-hole. The body is also designed so that it may remain engaged to the leads or pins after they are soldered to the board and the circuit board is assembled.

One problem associated with connector bodies and is well known in the industry is that the bodies of the various connectors often consume too much space between adjacent electrically connected circuit boards. The connector bodies thus cause the circuit boards to be spaced at a greater distance than desired. One response to this problem by those in the electrical industry has been to design connector bodies of reduced thickness. For example the thickness of a connector body for a through-hole connector may range from 0.10 inches to 0.05 inches.

While the design changes in connector bodies has resolved spacing problems for some applications, there still exists situations when the spacing constraints between circuit boards does not allow a connector body to reside therebetween. In this situation, it is necessary to remove the connector body engaged to the pins (or leads) from a first one of the circuit boards. When the connector body is removed, the pins (or leads) previously engaged to the connector body protrude outward from the first circuit board. This allows the connector body that remains engaged to the pins (or leads) of the second circuit board (or other receptacle positioned on the second board) to receive the protruding ends of the pins (or leads) of the first circuit board. The two circuit boards are then electrically connected and the spacing between the two circuit boards is reduced by at least the thickness of the removed connector body.

In order to remove a connector body from the pins (or leads), it is first necessary to insert the connector through the through-holes of the circuit board. The pins (or leads) are then soldered to the circuit board, with the body engaged to the pins, to engage the connector to the circuit board. The body must remain engaged to the pins during this process for two reasons. First, it is essential that the connector body and pins remain engaged until the pins (or leads) are engaged to the circuit board so that the uniform spacing of the pins (or leads) is precisely maintained. Second, a significant amount of force must be exerted to remove the connector body which is grippingly engaged to the leads or pins. Thus, the solder connection provides a sufficient restraining force, in some cases, to withstand the pull force required to remove the connector body. Typically the pins or leads are frictionally engaged to the connector body. The force required to pull the pins or leads out of the receptacles of the connector body is required to be significant to ensure that a reliable connection is maintained between the connector and various components connected thereto.

Thus, removing the connector body from the pins results in the pull force being exerted on the solder connection of the pins (or leads) to the circuit board. As known to those in the connector industry, this may cause damage to the solder connection and therefore result in poor quality electrical connections. In order to prevent this from occurring, it is necessary to carefully pull the connector body from the pins, and then inspect the solder connection to ensure no damage was done. Thus, current techniques for removing connector bodies are time-consuming, expensive and unreliable for reducing the spacing required between circuit boards.

Another problem with existing techniques for removing connector bodies is that the length of the pins (or leads) protruding from the surface of the circuit board is difficult, if not impossible, to adjust and/or vary. This is due to the force required to slide a pin frictionally engaged to the connector body. Thus, it is a time consuming and tedious task to adjust the length of each pin of the connector to ensure it is uniform and proper with the other pins.

What is therefore needed is a connector body which may be easily removed from pins or leads after they are soldered to a circuit board. The connector body should maintain the pins or leads at the desired spacing and length prior to soldering the connector to the board. The connector body should also be adaptable for use with either surface mount or through-hole connectors. Finally, the connector body should be readily manufactured from existing materials and techniques used for connector bodies. The present invention is directed towards these and other ends.

SUMMARY OF THE INVENTION

The present invention relates to electrical connectors and a removable body for use therewith. Electrical connectors typically include pins for insertion through through-holes formed on a mounting body. Alternatively, the electrical connector may include leads which are placed on a surface of the mounting body. In either case the pins or leads are soldered to attach the electrical connector to the mounting body. What is disclosed is a removable body engaged to the pins or leads, the removable body being easily disengaged from the pins or leads after the electrical connector is soldered to the mounting body. In addition, the removable body is designed to allow the length of the pins or leads protruding from the body to be easily moved relative to the removable body.

According to one aspect of the present invention, a removable body for an electrical connector assembly is disclosed. The removable body includes a pair of oppositely opposed lever arms, each of the lever arms rotatably engaged at opposite ends of at least one strut extending therebetween. The at least one strut is configured to allow passage of a plurality of substantially uniformly spaced pins therethrough. Each of the lever arms additionally includes at least one oppositely opposed abutment member protruding therefrom. The removable body also includes a tee section. The tee section includes a flange portion disposed between the strut(s) and the abutment members, a web portion disposed between the abutment members, and a plurality of substantially uniformly spaced holes defined by the flange portion, wherein each of the abutment members engages the pins disposed through the hole to the web portion when the lever arms are in a first position, and the abutment members are disengaged from the pins when the lever arms are actuated.

In another aspect of the invention, an electrical connector assembly is disclosed, the assembly including a removable body. The removable body includes a pair of oppositely opposed lever arms that include at least one oppositely opposed abutment member protruding therefrom. The removable body also includes a tee section disposed between the lever arms. The tee section includes a flange portion extending between the lever arms, the flange portion defining a first end and a second end rotatably engaged to a corresponding one of the lever arms. The flange portion additionally defines a plurality of uniformly spaced holes. The tee section further includes a web portion disposed between the abutment members. A plurality of pins are disposed through respective ones of the plurality of holes, wherein the abutment members engage the pins to the web portion when the lever arms are in a first position, and the plurality of pins are disengaged from the web portion when the lever arms are actuated.

In yet another aspect of the invention, a method for assembling two circuit boards is disclosed. At least one circuit board includes an electrical connector assembly, the electrical connector assembly including a removable body engaged to a plurality of pins. The removable body includes a pair of oppositely opposed lever arms, the lever arms each include at least one oppositely opposed abutment member protruding therefrom. The removable body further includes a tee section disposed between the lever arms. The tee section includes a flange with a first and second end, each end rotatably engaged to a respective one of the lever arms in a first position. The tee section further includes a web portion disposed between the abutment members, wherein the abutment members engage the pins to the web portion when the lever arms are in the first position, and the pins are disengaged when the lever arms are actuated. The method comprises the steps of: a) providing a first circuit board with at least one electrical connector assembly engaged thereto; b) removing the removable body from the at least one electrical connector assembly engaged to the first circuit board thereby leaving a plurality of pins protruding therefrom; c) providing a second circuit board with corresponding receptacles for receiving the plurality of pins of the first circuit board; and d) attaching the second circuit board to the first circuit board by mounting the plurality of pins of the first circuit board to the corresponding receptacles of the second circuit board.

One object of the present invention is to provide a body for an electrical connector assembly that is easily removed from the pins or leads engaged thereto.

It is another object of the present invention to provide an electrical connector assembly which allows the spacing between adjacent printed circuit boards to be reduced.

It is yet another object of the present invention to provide a removable connector body which may be removed from an electrical connector assembly without inducing a significant amount of stress or damage to a solder connection.

Another object of the present invention is to provide a removable body for an electrical connector assembly which is easy to use and readily manufactured from existing materials and techniques used for connector bodies.

Still another object of the present invention is to provide a body design for an electrical connector assembly which allows adjustment in the tail length or lead length of the pins or leads protruding therefrom.

These and other objects will become more apparent from the following description of the preferred embodiment.

DESCRIPTION OF THE PREFERRED EMBODIMENT

Figure 1:
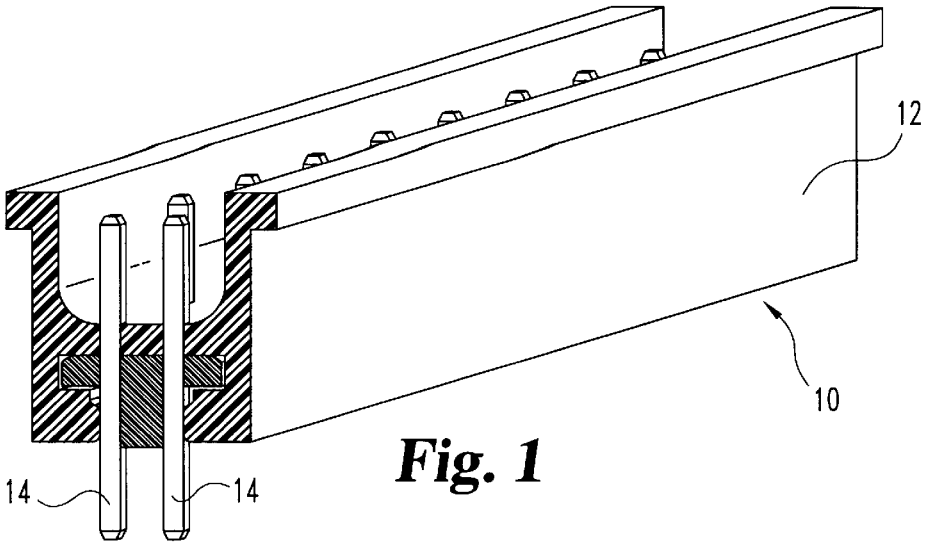
FIG. 1 is a perspective view of a portion of a preferred embodiment electrical connector assembly including the removable body of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A preferred embodiment of the present invention is illustrated in the perspective view of a portion of an electrical connector assembly in FIG. 1, and designated generally at 10. The electrical connector assembly 10 includes removable body 12, which holds a plurality of pins 14. The pins 14 are made from any conductive metal, such as copper. The connector assembly 10 may be engaged to a printed circuit board (not shown) by inserting each pin 14 through corresponding through-holes or receptacles formed on the circuit board. The pins 14 are then soldered to circuit traces on the opposite side of the board as is known in the art. It should be understood that the present invention contemplates that electrical connector assembly 10 could also be a surface mount connector. Pins 14 would be replaced with leads, and the connector assembly 10 would be mounted on the surface of a printed circuit board as known in the art.

Figure 2:
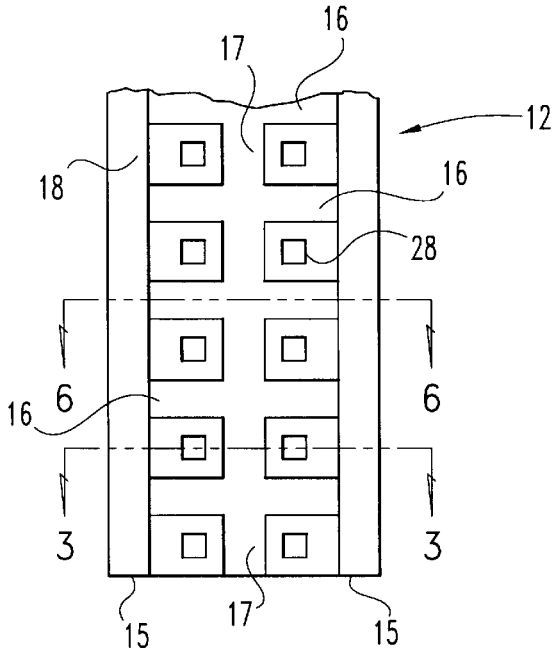
FIG. 2 is a top plan view of the portion of the preferred embodiment electrical connector assembly illustrated in FIG. 1 with the pins removed.
Figure 3:
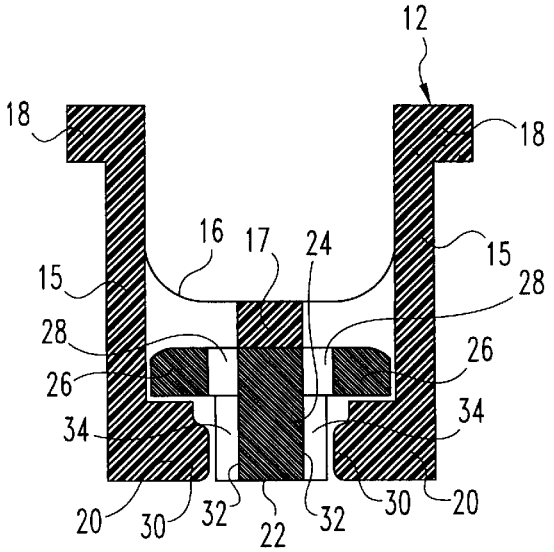
FIG. 3 is a section view of the preferred embodiment electrical connector assembly taken along line 3—3 of FIG. 2.

Referring now to FIGS. 2 and 3, a top plan view of the electrical connector assembly of FIG. 1 and a sectional view along line 3—3 of FIG. 2 are illustrated. The pins 14 are removed in the views of FIGS. 2 and 3 in order to show various aspects of the removable body 12 with clarity. Removable body 12 is preferably made from injection molded plastic as known in the art. Removable body 12 includes a pair of oppositely opposed lever arms 15. Lever arms 15 each include a gripping element 18 and a plurality of substantially uniformly spaced abutment members 20. The gripping elements 18 assist in actuating the lever arms 15 by providing a surface which allows engagement of lever arms 15 by, for example, the fingers of a person.

Each of the lever arms 15 are integrally formed with one end of each of a plurality of struts 16 extending therebetween. In the preferred embodiment, each end of strut 16 forms a rotatably resilient connection with lever arm 15 which biases each lever arm 15 in a first position that is illustrated by FIG. 3. Lever arms 15 are substantially parallel when in the first position. Each one of the plurality of struts 16 may be further engaged to a strut connector 17. Strut connectors 17 engage each strut 16 substantially near the mid-point between each end of the strut. The strut connectors 17 add further stability to the overall structure of removeable body 12 by ensuring the spacing distance between each of the struts 16 remains substantially constant.

Figure 4:
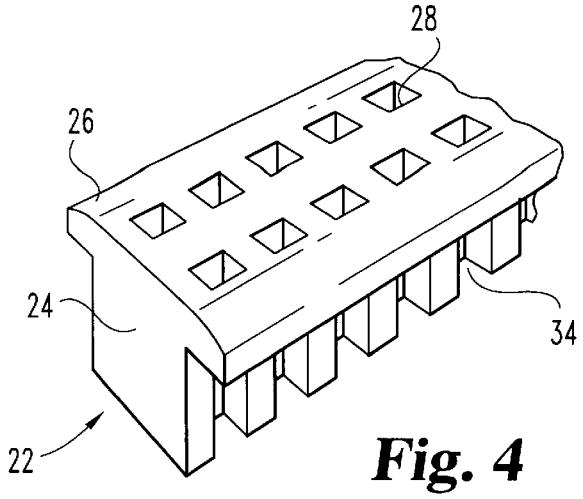
FIG. 4 is a perspective view of the removable tee member in accordance with one aspect of the present invention.

Removable body 12 further includes a tee member 22. Tee member 22 is shown separately from the remainder of removable body 12 in FIG. 4. Tee member 22 is disposed between the lever arms 15, and includes a flange portion 26 and web portion 24. Flange portion 26 is located between abutment members 20 and struts 16, and generally rests on abutment members 20, as shown in FIG. 3. Web portion 24 extends from flange portion 26 and is disposed between abutment members 20. In the preferred embodiment, tee section 22 is movable relative to the lever arms 15 of removeable body 12.

In a preferred embodiment, tee section 22 further includes a plurality of substantially uniformly space holes 28 defined by flange portion 26. Each hole 28 is configured to receive pins 14 as shown in FIG. 1. In one embodiment, each hole 28 is aligned with a corresponding recess 34 formed in web portion 24. Each recess is formed to receive a portion of pin 14. However, recess 34 does not completely encompass the pin 14 residing therein. Each recess 34 is configured so that an abutment surface 30 of each abutment member 20 engages each pin 14 disposed through hole 28 and residing in recess 34. Lever arms 15 are configured in such a manner that, when in the first position, abutment surface 30 engages pin 14, and the biasing force of each lever arm 15 causes the abutment member 20 to press pin 14 into recess 34 until it engages a recess surface 32. Pin 14 is thus held in position within removable body 12 by the frictional force between the pin and abutment surface 30 and recess surface 32. Recess 34 also prevents pin 14 from moving in a direction parallel with each lever arm.

In the preferred embodiment, each of the plurality of abutment members 20, corresponds to a hole 28 and a recess 34 formed to receive a pin 14. In an alternate embodiment, each lever arm 15 includes a single abutment member 20 which runs the entire length of the lever arm 15.

Figure 5:
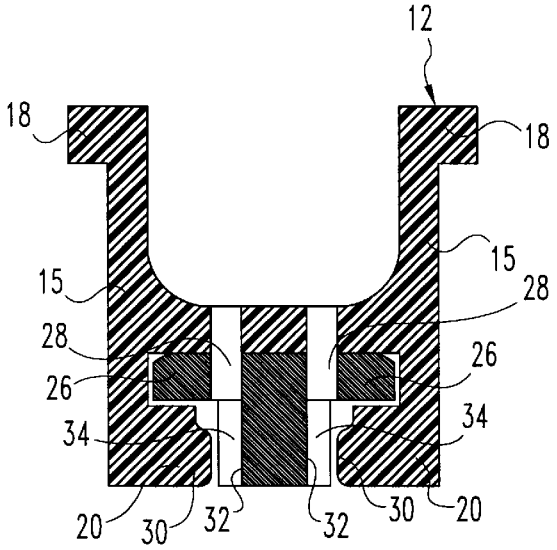
FIG. 5 is a section view of an alternate embodiment of the removable body of the electrical connector assembly of the present invention.

In one alternate embodiment illustrated in FIG. 5, flange portion 26 of tee member 22 is integrally formed with lever arms 15 in a manner similar to that described above for struts 16. In this embodiment, struts 16 are not included with removable body 12. The connection between flange portion 26 and lever arms 15 allows lever arms 15 to be biased in the first position, and to be rotated about ends of flange portion 26. Thus, flanges 26 replace struts 16, and the tee section 22 is fixed between lever arms 15 via flange portion 26.

Figure 6:
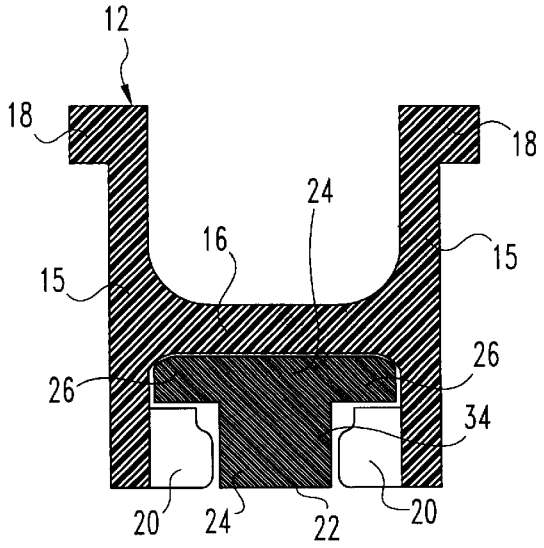
FIG. 6 is a section view of the preferred embodiment electrical connector assembly taken along line 6—6 of FIG. 2.

Referring now to FIG. 6, a section through removable body 10 taken through line 6—6 of FIG. 2 is illustrated. As can be seen in FIG. 6, each strut 16 extends between each lever arm 15 as previously described. In one alternate embodiment, strut 16 is comprised of a single strut 16 extending between lever arms 15. The single strut 16 defines a plurality of substantially uniformly spaced through-holes corresponding to holes 28 of flange portion 26 for passage of pins 14 therethrough. FIG. 6 also illustrates that web portion 24 of tee section 22 has a wider cross-section between holes 28, thus forming the recess 34. In one alternate embodiment, the web portion 24 has a uniform width and does not include any recesses 34. FIG. 6 also illustrates that, in the preferred embodiment, each lever arm 15 includes a plurality of abutment members 20 spaced to correspond with each hole 28. However, as described above, an alternate embodiment of removable body 12 contemplates that each abutment member 20 is replaced with a continuous single abutment as described above.

Referring now to FIGS. 1–6, the operation of removable body 12 will now be explained. As the gripping elements 18 are pushed together, the lever arms 15 each rotate from the first position about the opposite end of each of a plurality of struts 16, which is integrally formed thereto in a rotatably resilient connection. When the lever arms 15 are actuated, the lever arms 15 rotate about the corresponding end of each strut 16 causing each abutment member 20 to disengage from each pin 14. When the gripping elements 18 are released, the resilient connection between the lever arms 15 and struts 16 causes the lever arm to return to the first position, and each abutment member 20 re-engages each pin 14.

Figures 7A, 7B, 7C, 7D:
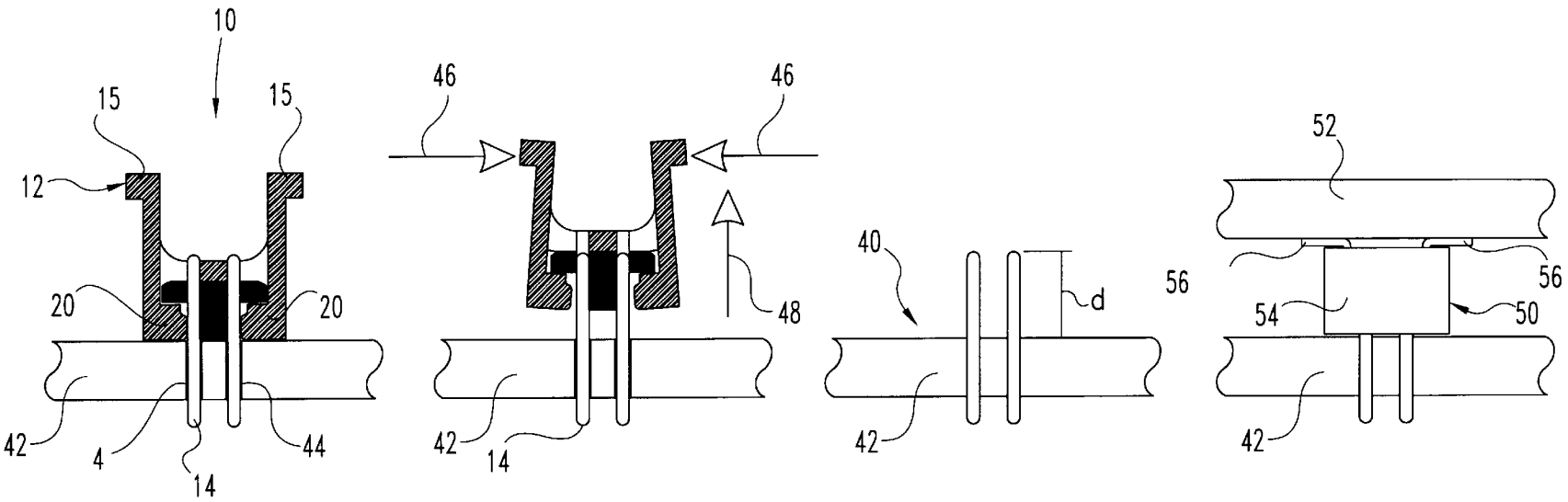
FIGS. 7A–7D are a series of section views illustrating one specific application of the preferred embodiment electrical connector assembly of FIG. 1.

Referring now to FIGS. 7A–7D, one specific application of the present invention is illustrated therein. In FIG. 7A, the connector assembly 10 is shown engaged to a first circuit board 42. Circuit board 42 defines through-holes 44, which correspond to and receive pins 14 of connector assembly 10. Pins 14 may then be soldered to a circuit trace on circuit board 42 as known in the art.

Referring now to FIG. 7B, the removable body 12 is removed from pins 14 by pressing the gripping elements 18 of lever arms 15 in the direction indicated by first arrows 46. Actuation of lever arms 15 in the direction indicated by first arrows 46 releases abutment surfaces 30 from pins 14, thereby substantially reducing or eliminating the frictional resistance force between pin 14, abutment surface 30, and recess surface 32. Thus, pin 14 may move relative to removeable body 12 with little or no resistance. Removable body 12 may then be easily removed from pins 14 by lifting the removable body 12 in the direction indicated by second arrow 48.

Referring now to FIG. 7C, once removable body 12 is removed as described above pins 14 remain engaged to first circuit board 42. The removal of removable body 12 induces little or no stress in the solder connection of pins 14 to circuit board 42, and thus ensures that a reliable connection is maintained.

In accordance with another principle of the current invention, pins 14 include a lead length (or alternatively, a tail length) after removeable body 12 is disengaged therefrom, and indicated by "d" in FIG. 7C. It should be understood that the present invention allows the length "d" to be adjusted to any desired length prior to connecting the pins 14 to circuit board 42. The height of the pins 14 is adjusted by actuating lever arms 15, as described above, and moving pins 14 relative to removeable body 12 to the desired length.

Referring now to FIG. 7D, a second printed circuit board 52 with a second connector assembly 50 attached thereto is provided. In FIG. 7D, the connector assembly 50 is shown as a surface mount connector. However, it should be understood that the second connector assembly may be a through-hole connector, or any other device capable of receiving pins 14, as known in the art. Second connector assembly 50 is placed over pins 14 to electrically connect the first circuit board 42 to the second circuit board 52, as known in the art. The present invention allows the spacing between circuit board 42 and circuit board 52 to be reduced without compromising the integrity of the solder by subjecting the connection to the excessive external force required to remove prior art connector bodies.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A removable body for an electrical connector assembly, the removable body comprising:

a pair of oppositely opposed lever arms, each having at least one oppositely opposed abutment member protruding therefrom;

at least one strut extending between the lever arms such that each of the lever arms is rotatably engaged at opposite ends thereof, the at least one strut allowing passage of a plurality of substantially uniformly spaced pins therethrough;

a tee section, the tee section including:

a flange portion disposed between the at least one strut and the abutment members;

a web portion disposed between the abutment members; and a plurality of substantially uniformly spaced holes defined by the flange portion, wherein each of the abutment members engages the pins disposed through respective ones of the holes to the web portion when the lever arms are in a first position, and the abutment members are disengaged from the pins when the lever arms are actuated.

2. The removeable body of claim 1, further comprising a gripping element integrally formed at one end of each lever arm.

3. The removable body of claim 1, wherein the tee section is movable relative to the pair of lever arms when the pins are removed.

4. The electrical connector assembly of claim 1, wherein the removable body is for a through-hole electrical connector.

5. The electrical connector assembly of claim 1, wherein the removable body is for a surface mount electrical connector.

6. The removable body of claim 1, wherein the at least one abutment member comprises a plurality of abutment members.

7. The removeable body of claim 1, wherein the at least one strut comprises a plurality of substantially uniformly spaced struts.

8. The removable body of claim 7, further comprising a strut connector extending from each one of the plurality of struts to engage an adjacent one of the plurality of struts.

9. An electrical connector assembly, comprising:

a removable body including:

a pair of oppositely opposed lever arms, each of the lever arms having at least one oppositely opposed abutment member protruding therefrom;

a tee section disposed between the lever arms, the tee section including:

a flange portion extending between the lever arms such that each of the lever arms is rotatably engaged at opposite ends thereof, the flange portion additionally defining a plurality of uniformly spaced holes;

a web portion disposed between the abutment members; and a plurality of pins disposed through respective ones of the plurality of holes, wherein the abutment members engage the pins to the web portion when the lever arms are in a first position, and the plurality of pins are disengaged from the web portion when the lever arms are actuated.

10. The electrical connector assembly of claim 9, wherein each of the lever arms includes a plurality of abutment members.

11. The electrical connector assembly of claim 9, further comprising a gripping element integrally formed at one end of each lever arm.

12. The electrical connector assembly of claim 9, wherein the connector assembly is a through-hole connector assembly.

13. The electrical connector assembly of claim 9, wherein the connector assembly is a surface mount connector assembly.

14. The electrical connector assembly of claim 8, wherein the web portion defines a plurality of recesses corresponding to the holes, whereby the recesses receive a portion of a pin disposed through the corresponding hole.

15. A method for assembling two circuit boards, wherein at least one circuit board includes an electrical connector assembly, the method comprising the steps of:

a) providing a first circuit board with at least one electrical connector assembly engaged thereto, the electrical connector assembly including a removable body engaged to a plurality of pins, the removable body including a pair of oppositely opposed lever arms each including at least one oppositely opposed abutment member protruding therefrom, the removable body further including a tee section disposed between the lever arms, the tee section including a flange with each lever arm rotatably engage at opposite ends thereof to bias the lever arms in a first position, the tee section further including a web portion disposed between the abutment members, wherein the abutment members engage the pins to the web portion when the lever arms are in the first position, and the pins are disengaged when the lever arms are actuated;

b) removing the removable body from the at least one electrical connector assembly engaged to the first circuit board, thereby leaving the plurality of pins engaged to the first circuit board;

c) providing a second circuit board with corresponding receptacles for receiving the plurality of pins of the first circuit board; and d) attaching the second circuit board to the first circuit board by mounting the plurality of pins of the first circuit board to the corresponding receptacles of the second circuit board.

16. The method of claim 15, wherein step (a) further comprises the steps of: (a.1) providing an electrical connector assembly including a removable body engaged to a plurality of pins, the removable body including a pair of oppositely opposed lever arms each including at least one oppositely opposed abutment member protruding therefrom, the removable body further including a tee section disposed between the lever arms, the tee section including a flange with each lever arm rotatably engage at opposite ends thereof to bias the lever arms in a first position, the tee section further including a web portion disposed between the abutment members, wherein the abutment members engage the pins to the web portion when the lever arms are in the first position, and the pins are disengaged when the lever arms are actuated; (a.2) adjusting the pins of the electrical connector assembly to a desired length; and (a.3) engaging the electrical connector assembly to a first circuit board.

17. The method of claim 15, wherein the electrical connector assembly is a surface mount connector.

18. The method of claim 15, wherein the electrical connector assembly is a through-hole connector.

* * * * *

UNITED STATES PATENT AND TRADEMARK OFFICE

CERTIFICATE OF CORRECTION

PATENT NO. : 5,964,596
DATED : October 12, 1999
INVENTOR(S) : Vicich et al.

It is certified that error appears in the above-identified patent and that said Letters Patent is hereby corrected as shown below:

Column 5,
Lines 27-29, please delete "assist in actuating...the fingers of a person" and insert -- provide an extension from the lever arm 15 which assists an operator of the connector assembly in maintaining a grip on the lever arm --.

Column 7,
Lines 45 and 46, please delete "oppositely".
Line 49, please change "rotatably" to -- pivotally --.
Line 64, please change "actuated" to -- pivoted toward one another --.

Column 8,
Lines 4 and 7, please change "electrical connector assembly" to -- removable body --.
Line 21, please delete "oppositely".
Line 27, please change "rotatably" to -- pivotally --.
Line 38, please change "actuated" to -- pivoted toward one another --.
Line 51, please change "assembly of claim 8" to -- assembly of claim 9 --.

Column 10,
Lines 2 and 3, please delete "oppositely".

Signed and Sealed this

Fifteenth Day of April, 2003

JAMES E. ROGAN
*Director of the United States Patent and Trademark Office*